United States Patent [19]

Yamazaki et al.

[11] Patent Number: 4,693,016

[45] Date of Patent: Sep. 15, 1987

[54] DRYING APPARATUS

[75] Inventors: Seiichi Yamazaki; Kaoru Uchiyama; Toshiro Tahara, all of Kanagawa, Japan

[73] Assignee: Fuji Photo Film Co., Ltd., Kanagawa, Japan

[21] Appl. No.: 851,194

[22] Filed: Apr. 14, 1986

[30] Foreign Application Priority Data

Apr. 15, 1985 [JP] Japan ..... 60-079977

[51] Int. Cl.[4] ..... F26B 13/12; F26B 13/16

[52] U.S. Cl. ..... 34/52; 34/115; 34/122

[58] Field of Search ..... 34/52, 110, 115, 122; 68/DIG. 5

[56] References Cited

U.S. PATENT DOCUMENTS

| | | | |
|---|---|---|---|
| 2,074,455 | 3/1937 | Carleton | 34/110 |
| 3,827,855 | 8/1974 | Blake | 34/115 |
| 4,011,124 | 3/1977 | Baxter | 34/115 |
| 4,036,684 | 7/1977 | Schmitt et al. | 34/115 |
| 4,135,310 | 1/1979 | Fuhring et al. | 34/52 |

*Primary Examiner*—Albert J. Makay

*Assistant Examiner*—David W. Westphal

*Attorney, Agent, or Firm*—Sughrue, Mion, Zinn, Macpeak, and Seas

[57] ABSTRACT

A drying apparatus for drying photographic paper includes a rotary drum and a duct having a recess which is provided with air outlet bores. A photographic paper passing area is defined between the outer periphery of the drum and the recess of the duct. The warm air blown out of the air outlet bores presses the side (the reverse side) of the photographic paper which is opposite to the emulsion layer side thereof against the outer periphery of the rotary drum, thereby maintaining the emulsion layer side of the paper in a non-contact state while the paper is being transported. The rotary drum is provided with bores through which the warm air is sucked in so as to suction-hold the photographic paper on the outer periphery of the rotary drum, whereby the photographic paper is also heated from the reverse side thereof. If the rotary drum is rotated at a higher peripheral speed than the speed of travel of the photographic paper, if it possible to prevent the formation of any dent in the reverse side of the photographic paper by the action of the suction bores.

11 Claims, 11 Drawing Figures

DRYING APPARATUS

BACKGROUND OF THE INVENTION

1. Field of the Invention

The present invention relates to a drying apparatus for use in a drying step in a photographic processing of photographic paper.

2. Description of the Related Art

Drying of photographic paper in a photographic processing is carried out by blowing drying air (warm air) against the photographic paper while it is being transported from the washing or rinsing section after the water droplets have been wiped off from the paper by means of a squeegee such as a roller or a blade. When it is still wet, the emulsion layer of photographic paper is easily flawed by coming into contact with any portion or member of the drying apparatus. The possibility of the emulsion layer contacting a portion or member of the drying apparatus greatly differs depending upon the structure and arrangement of the drying apparatus employed, mainly the photographic paper transporting system and the way in which the drying air is applied to the wet photographic paper. It is therefore preferable that the drying apparatus employed has a structure in which the photographic paper is transported without any risk of the emulsion layer thereof contacting a portion or member of the apparatus and in which the photographic paper is prevented from fluttering when subjected to the blast of drying air.

If drying progresses unevenly on each of the portions of the photographic paper, they are not dried uniformly. For this reason, the drying apparatus preferably has a structure which enables the photographic paper to be dried uniformly. If the progress of drying becomes imbalanced between the obverse and reverse sides of the photographic paper, the paper curls in the form of a trough, and the curling portion may contact a portion or member of the apparatus, which leads to formation of a flaw and hindrance to the transportation of the photographic paper. Therefore, it is preferable that the drying apparatus is arranged in consideration of the balance that is necessary in terms of the progress of drying as between the obverse and reverse sides of the photographic paper. Since the drying air supplied contacts the wet photographic paper, the air becomes damp, and the temperature of the drying air is also lowered.

If the drying air which has become damp following contact with the wet photographic paper is applied to the paper again in that state, the drying efficiency is deteriorated. For this reason, the drying apparatus is preferably arranged such that the drying air supplied leaves immediately after contacting the wet photographic paper. Further, in order to reduce the size and the production cost of the apparatus, it is preferable to arrange a drying apparatus in such a fashion that it has a structure which enables the heat to be effectively used and which permits the number of required elements to be reduced be allowing, for example, transporting means to serve also as drying means.

SUMMARY OF THE INVENTION

In view of the above-mentioned circumstances experienced with the prior art, it is a primary object of the present invention to provide a drying apparatus for use in a photographic processing system which enables photographic paper to be efficiently dried within a short period of time without any risk of the emulsion layer thereof being flawed.

To this end, the present invention provides a drying apparatus which comprises: a rotary drum having bores provided in the peripheral surface thereof and adapted to rotate in the photographic paper transporting direction; a duct having air outlet bores provided in a curved surface thereof which faces the peripheral surface of the rotary drum; a photographic paper passing area defined by a gap between the rotary drum and the duct which faces it; and air blowing means for blowing drying air out of the air outlet bores of the duct toward the outer periphery of the rotary drum, thereby bringing the reverse side of the photographic paper into contact with the outer periphery of the rotary drum.

By virtue of this arrangement, the photographic paper which is led to the outer periphery of the rotary drum has the reverse side thereof pressed against said outer periphery by the pressure of the air blown out of the air outlet bores of the duct. Accordingly, the photographic paper is transported while the obverse side thereof is maintained in a non-contact state, which prevents the surface of the paper from being flawed.

Since the rotary drum is pre-heated by the air from the bores, the photographic paper is heated from both the obverse and reverse sides thereof, and the drying is thereby completed within a short period of time. The air which has been made damp by the drying of the obverse surface of the photographic paper is discharged through the bores, which also enables the drying efficiency to be improved.

If the rotary drum is rotated at higher peripheral speed than the speed of travel of the photographic paper, the paper travels in such a manner that the reverse side thereof moves relative to the rotary drum, which prevents the formation of any dent in the reverse side of the paper by the action of the suction bores.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and in which.

DETAILED DESCRIPTION OF THE PREFERRED EMBODIMENT

Figure 1:
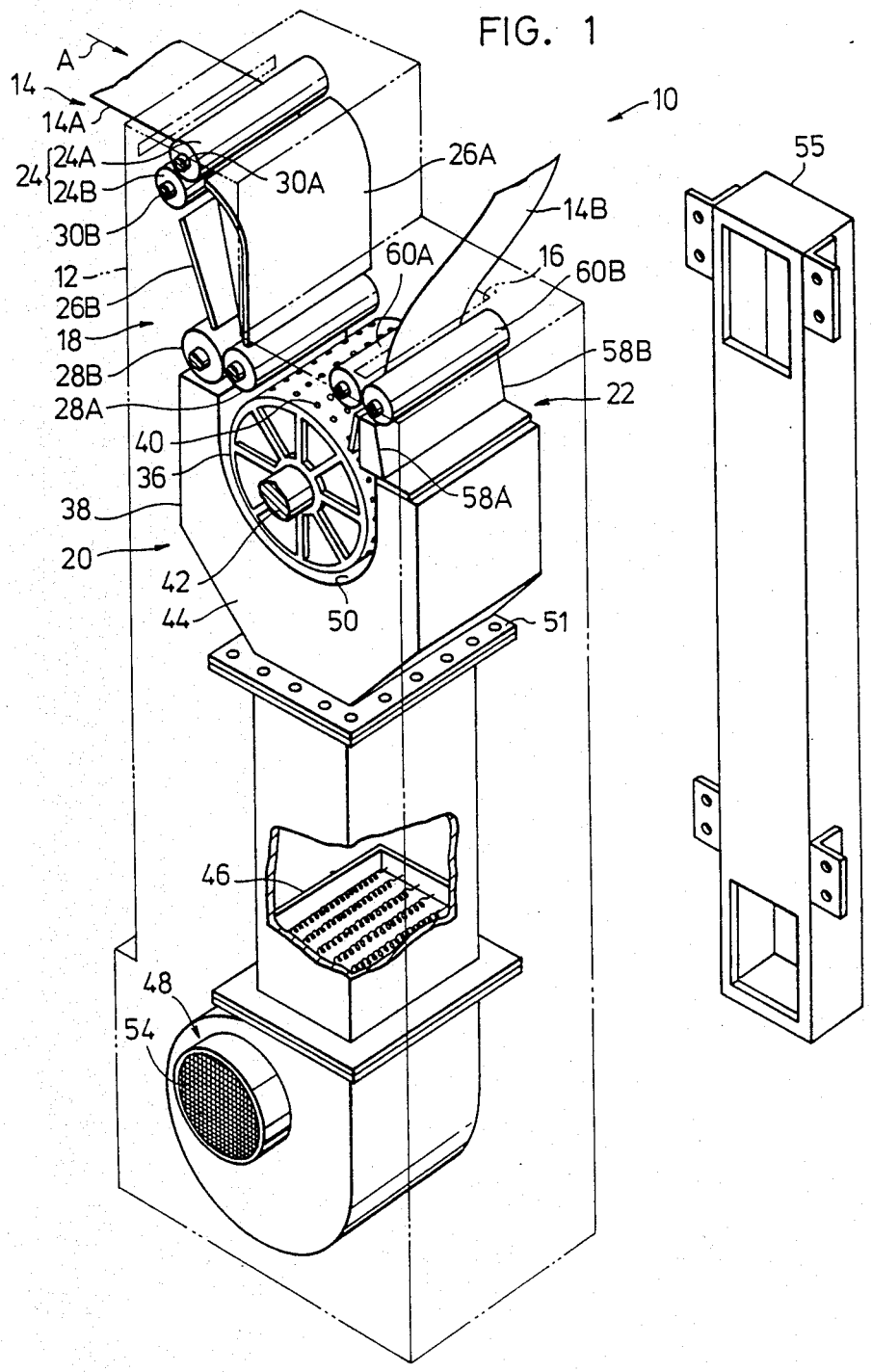
FIG. 1 is a perspective view of a drying apparatus for a photographic processing system in accordance with one embodiment of the present invention.

FIG. 1 is a perspective view of a drying apparatus 10 for a photographic processing system in accordance with one embodiment of the present invention.

The whole of the drying apparatus 10 is covered with a box-like casing 12. Photographic paper 14 is inserted immediately after development in the form of wet photographic paper 14A into the apparatus 10 from the left-hand side of the casing 12 as viewed in FIG. 1 (in the direction of the arrow A), and after being dried, the photographic paper 14 is discharged in the form of dried photographic paper 14B from a rectangular outlet 16 provided in the upper side of the casing 12.

The casing 12 incorporates an inlet-side guide section 18, a drying apparatus body 20 and an outlet-side guide section 22.

Each of the rotary shafts 30A, 30B of lead-in rollers 24A, 24B has both axial end portions thereof rotatably supported by the casing 12. The lead-in rollers 24A, 24B have the same configuration as each other, the surface layers thereof being made of a phenolic resin. The rollers 24A, 24B are disposed in such a manner that they clamp the photographic paper 14 fed thereto and feed it into the area between guide plates 26A, 26B.

The guide plates 26A, 26B have their lateral ends secured to the casing 12 and are disposed such that when the leading end of the photographic paper 14 passes through the area defined therebetween, the paper 14 is reliably fed into the area between driving rollers 28A, 28B.

The driving roller 28A is rotated at all times by a motor (not shown). The rate of feed of the photographic paper 14 is determined by the rotational speed of the driving roller 28A.

The driving force of the driving roller 28A is also transmitted to other rollers by means of chains (not shown) so that these rollers rotate in unison with the roller 28A. However, the driving rollers 28A, 28B are rotated at a higher speed than that of the lead-in rollers 24A, 24B so that after the leading end of the photographic paper 14 has been clamped between the drivng rollers 28A, 28B, any sag in the portion of the paper 14 between the rollers 28A, 28B and the lead-in rollers 24A, 24B is eliminated.

When the sag in the photographic paper 14 has been eliminated, the rotational speed of the driving rollers 28A, 28B is changed such as to be equal to that of the lead-in rollers 24A, 24B, so that it is possible to prevent the driving rollers 28A, 28B from slipping on the photographic paper 14.

Figure 3:
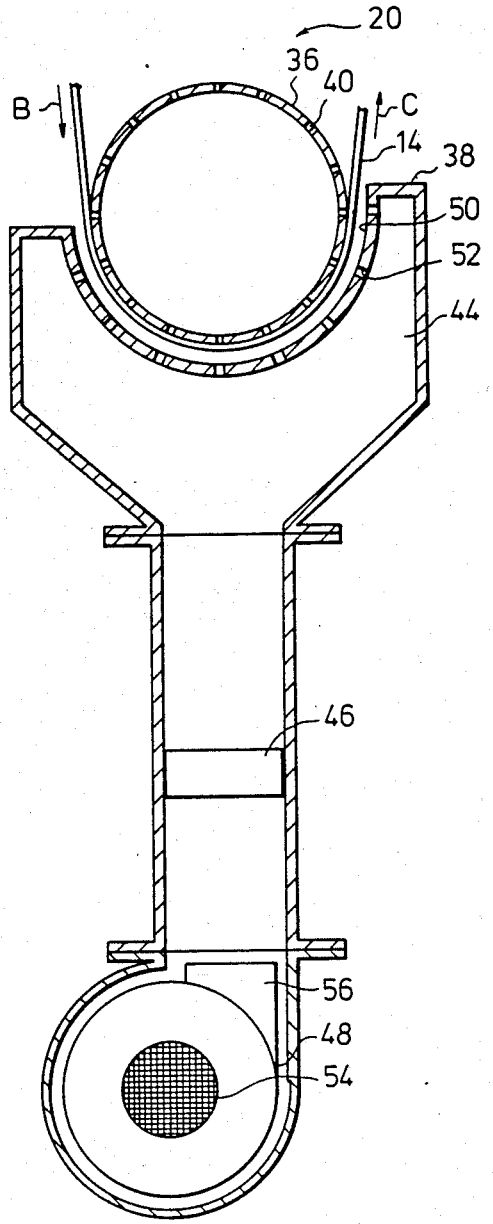
FIG. 3 shows the internal structure of the drying apparatus body.

The drying apparatus body 20 is disposed on the downstream side of the driving rollers 28A, 28B. The body 20 includes a rotary drum 36 over which the photographic paper 14 is passed, as shown in FIG. 3.

Figure 4:
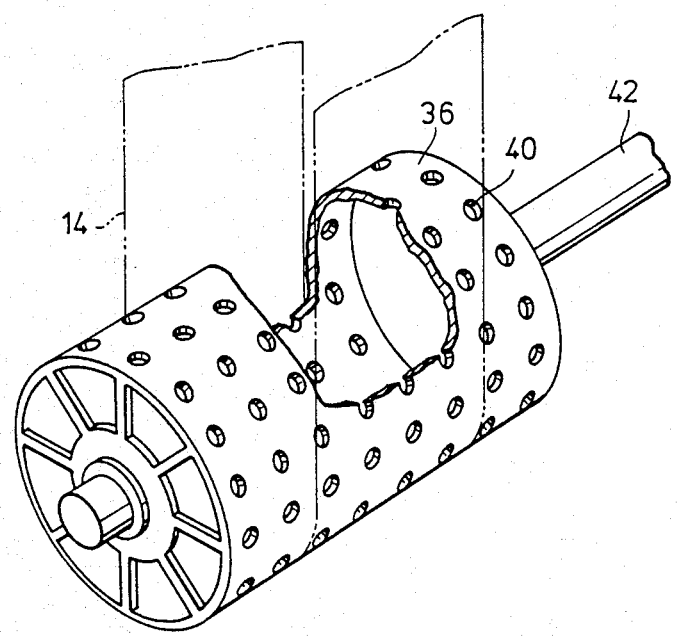
FIG. 4 is perspective view of the rotary drum in accordance with the embodiment.

The rotary drum 36 has, as shown in FIG. 4, the form of a hollow cylinder having a width greater than that of the photographic paper 14. The paper 14 comes into contact with the rotary drum 36 at one side thereof as shown by the arrow B in FIG. 3 and is passed over about one half of the outer periphery thereof, changing direction as it does so, and finally being led out in the direction of the arrow C.

The photographic paper 14 is dried while it is in contact with the outer periphery of the rotary drum 36. Therefore, when the paper 14 leaves the rotary drum 36, it has already become the dried photographic paper 14B.

As shown in FIG. 4, a plurality of circular bores 40 are provided in the outer periphery of the rotary drum 36, the bores 40 serving as suction bores. Both end faces of the drum 36 have relatively large openings which are communicated with the interior of the drum 36 which is hollow.

The rotary shaft 42 of the rotary drum 36 is connected to a driving gear through coupling means (not shown). Thus, the rotary drum 36 is activated by the driving gear so as to rotate in the direction in which the photographic paper 14 is transported. In this embodiment, the rotary drum 36 is adapted to rotate at a peripheral speed about 10% above the speed of travel, or the rate of feed, of the photographic paper 14.

In consequence, the rotary drum 36 and the portion of the reverse side of the photographic paper 14 which is in contact with the surface of the drum 36 move relative to each other while in contact with each other, so that it is possible to prevent the generation of any dents in the paper 14, which phenomenon would occur due to the reverse side of the paper 14 being pressed onto the bores 40 if the rotary drum 36 and said portion of the paper 14 were to turn at the same speed.

As shown in FIG. 3, a drying air duct 38 is disposed below the rotary drum 36. The duct 38 includes a duct body 44 which is provided in the upper end surface thereof with a recess 50 having a curved surface adapted to accommodate one half of the rotary drum 36 in the circumferential direction.

The recess 50 has a circular cross-section which surrounds about one half of the outer periphery of the rotary drum 36. A predetermined gap or space is provided between the recess 50 and the rotary drum 36 so as to define a photographic paper passing area.

Figure 5:
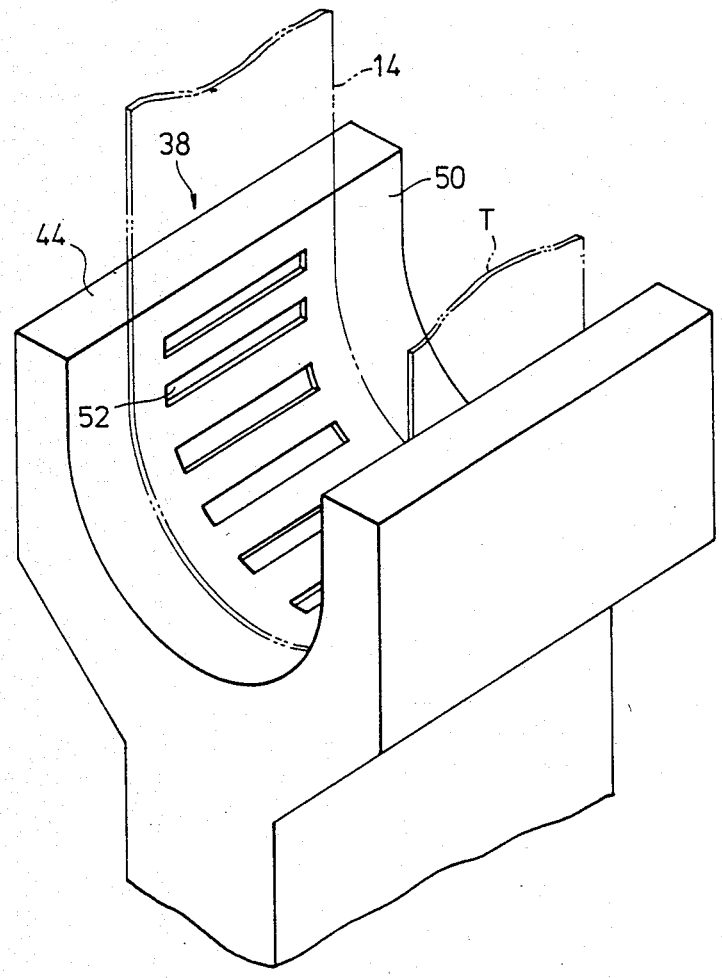
FIG. 5 is a perspective view of the drying air duct in accordance with the embodiment.

Referring to FIG. 5, the recess 50 is provided with a plurality of slits 52 the longitudinal axes of which extend orthogonally with respect to the traveling direction of the photographic paper 14, the slits 52 serving as air outlet bores. The warm air inside the duct body 44 is blown out of the slits 52.

The longitudinal length of each slit 52 in this embodiment is set such as to be smaller than the width of the photographic paper 14, so that even if the emulsion layer side of the leading end of the photographic paper 14 curls (see the portion of the paper 14 denoted by the reference symbol T in FIG. 5) when the drying of the paper 14 is started, the curled end of the paper 14 is not caught by any slit 52 and the paper 14 is able to travel without any hindrance. In addition, these slits 52 cause both lateral edge portions of the paper 14 to be pressed against the outer periphery of the rotary drum 36, thus reducing the degree of curl experienced by the paper 14.

The warm air blown out of the slits 52 strikes the surface of the photographic paper 14 and passes over it to enter the rotary drum 36 through the bores 40, whereby the rotary drum 36 itself is also heated by the warm air, so that it is possible to dry the photographic paper 14 from both obverse and reverse sides thereof.

A heater 46 is installed at a vertically intermediate position inside the duct body 44.

Further, a blower 48 is installed in the lower part of the duct body 44. The air inlet-side portion 54 of the blower 48 and the end face of the rotary drum 36 are communicated with each other through a return duct 55. Accordingly, the warm air discharged from the end face of the rotary drum 36 is returned to the heater 46 by the action of the blower 48 so as to be recirculated to the photograhic paper 14.

Figure 6:
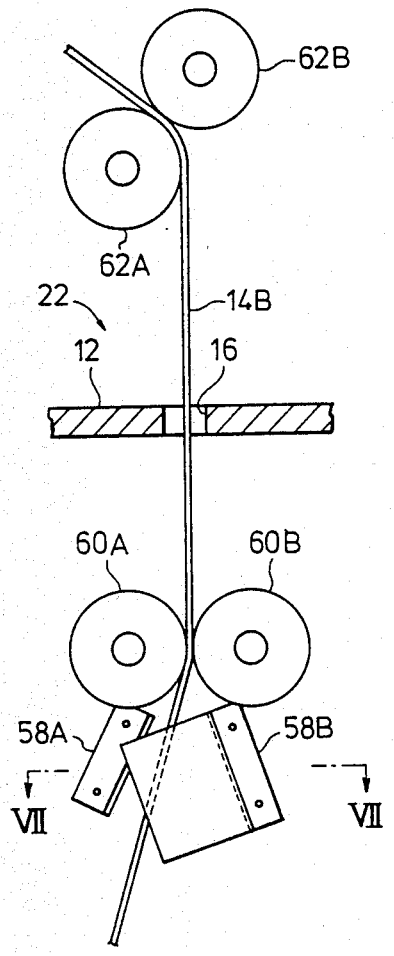
FIG. 6 is a front elevational view of the outlet-side guide section of the drying apparatus.

As shown in FIG. 6, the dried photographic paper 14B is discharged from the rectangular outlet 16 of the casing 12 by the action of the outlet-side guide section 22, and the paper 14B is thereby taken out from the drying apparatus 10.

In the outlet-side guide section 22, a pair of guide plates 58A, 58B are secured to the casing 12, and a pair of rollers 60A, 60B are rotatably supported by the casing 12 at the downstream side of the guide plates 58A, 58B. The rollers 60A, 60B are adapted to feed the photographic paper 14 which is guided by the guide plates 58A, 58B in such a manner that the paper 14 is led toward the outlet 16.

Figure 7:
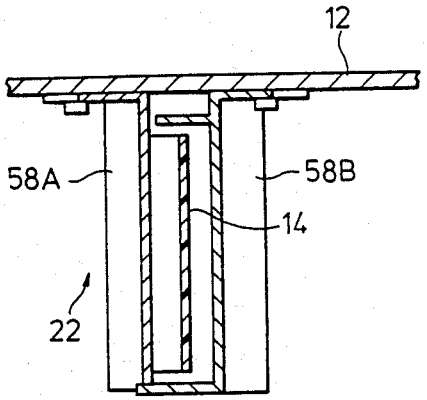
FIG. 7 is a sectional view taken along the line VII—VII of FIG. 6.

As shown in FIG. 7, the guide plate 58B has a U-shaped cross-section and defines, together with the guide plate 58A, a guide area having an opening with a rectangular cross-section. Thus, the guide plates 58A, 58B guide the photographic paper 14 in such a manner that the paper 14 moves inside the guide area from the lower side to the upper side as viewed in FIG. 6, so that it is possible to guide the paper 14 while limiting also the lateral movement thereof.

Figure 2:
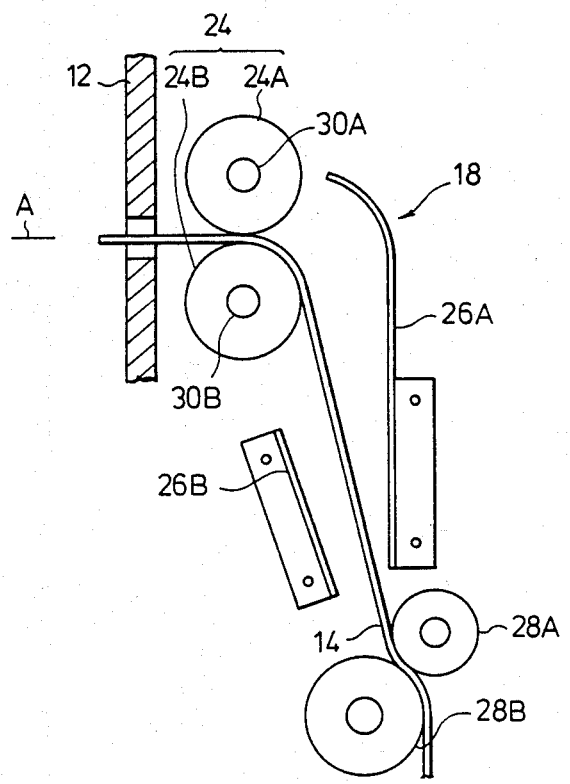
FIG. 2 is a front elevational view of the inlet-side guide section of the drying apparatus.

Similar to the rollers 24A, 24B which are shown in FIG. 2, the rollers 60A, 60B have their surface layers made of a phenolic resin so that they do not damage the obverse and reverse surfaces of the photographic paper 14.

Further, a pair of driving rollers 62A, 62B are rotatably supported in the vicinity of the outlet 16 and are rotated in unison with the driving roller 28B at a higher peripheral speed than the traveling speed of the photographic paper 14. The torque of the driving rollers 62A, 62B is preferably set such as to be smaller than that of the driving rollers 28A, 28B.

The following is a description of the operation of the embodiment detailed above.

As shown in FIG. 1, the photographic paper 14A which has been washed and is still wet is transported to the drying apparatus 10 in the direction of the arrow A.

The leading end of this wet photographic paper 14A is fed into the area between the lead-in rollers 24A, 24B and then passed through the area between the driving rollers 28A, 28B so as to be fed to the rotary drum 36.

The leading end of the photographic paper 14 is reliably inserted into the space between the rotary drum 36 and the recess 50 by the action of the driving rollers 28A, 28B, and the reverse side of the paper 14 is brought into contact with the outer periphery of the rotary drum 36 as shown by the arrow B in FIG. 3.

Since warm air is blown against the obverse side of the photographic paper 14, it is pressed against the outer periphery of the drum 36, and while doing so, the leading end of the paper 14 is transported toward the outlet-side guide section 22.

Since a plurality of slits 52 are provided in the recess 50 of the drying air duct 38 and the opening area of each slit 52 is relatively small, the warm air blown out of the slits 52 uniformly strikes the photographic paper 14 over a relatively wide range and at a relatively high wind velocity, so that the paper 14 is brought into close contact with the outer periphery of the rotary drum 36 by the pressure of the warm air. In addition, the reverse side of the paper 14 is also dried by the potential heat of the drum 36 which is pre-heated by the warm air. Therefore, the time required for drying is advantageously short, and there is no risk of the paper 14 being dried unevenly. The drying of the photographic paper 14 from both obverse and reverse sides thereof offers the additional advantage that the degree of curl experienced by the paper 14 is reduced.

One half of the outer periphery of the rotary drum 36 over which no photographic paper is passed is re-heated at all times during the drying operation. It is therefore possible to pre-heat the whole outer periphery of the drum 36 every time it completes one full turn.

Further, since the rotary drum 36 is rotated at a higher peripheral speed than the speed of travel of the photographic paper 14, the drum 36 rotates while sliding on the reverse side of the paper 14. In consequence, it is possible to prevent the circular bores 40 of the drum 36 from staying at any particular positions on the photographic paper 14, and this prevents the formation of any dent in the paper 14 even when it is brought into close contact with the outer periphery of the rotary drum 36 by the pressure of the warm air blowing against it.

The duct body 44 is closed except for the recess 50 and the air inlet-side portion 54 of the blower 48 which are communicated with the outside. It is therefore possible to blow the warm air out of the slits 52 at an appropriately high wind velocity without the need to send the air by utilizing a very high pressure produced by the blower 48.

As described above, the arrangement in accordance with this embodiment enables the photographic paper 14 to be dried by means of the warm air blown out of the slits 52 simply by providing the rotary drum 36 and the duct body 44. Accordingly, the structure of the photographic paper transporting path is simplified, and the size of the apparatus is reduced as a whole.

Although in the above embodiment the slits 52 which are formed in the recess 50 are simply through-holes having a rectangular cross-section, if each slit 52 is provided with a flap 52A which extends from the upstream-side end toward the downstream-side end of the slit 52 and which slants toward the rotary drum 36, the photographic paper 14 is guided more smoothly. In such a case, even if the longitudinal length of the slits 52 is greater than the width of the paper 14, there is no risk of the leading end of the paper 14 being caught by any slit 52. The flaps 52A may be formed at the same time as the slits 52 are formed in the drum body 44. More specifically, it is possible to provide each flap 52A through formation of the associated slit 52 by cutting and raising a portion of the drum body 44. It is a matter of course that the slits 52 are not necessarily exclusive and the air outlet bores may have any kind of configuration.

Figure 8:
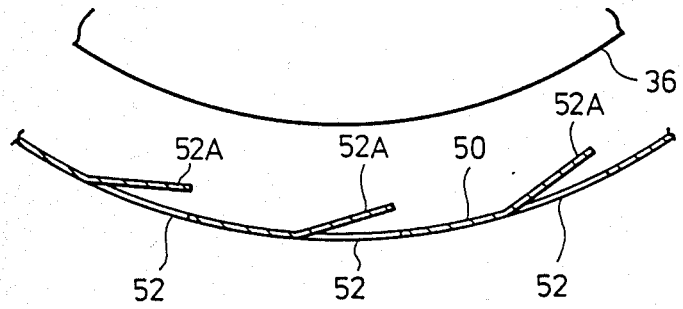
FIGS. 8 and 9 are sectional views respectively showing arrangements in which each of the slits is provided with a flap.
Figure 9:
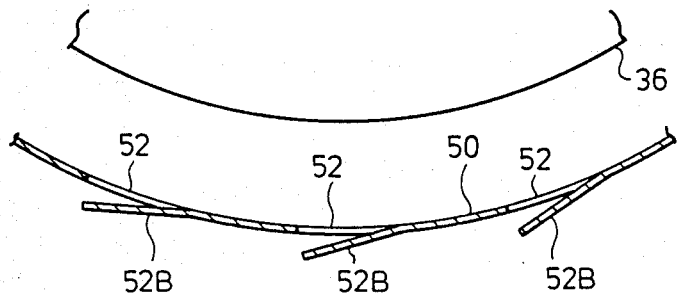

Referring to FIG. 9, there is shown another arrangement in which each of the flaps 52B is formed such as to extend in a direction different from that of the flaps 52A shown in FIG. 8, that is, from the downstream-side end toward the upstream-side end of the associated slit 52, and to project away from the rotary drum 36, the slits 52 being provided through formation of the flaps 52B. Since, in this arrangement, the flaps 52B do not project toward the rotary drum 36, it is possible for the photographic paper 14 to be transported even more smoothly.

Although in the above embodiment the circular bores 40 are formed by directly boring through the rotary drum 36, the arrangement may be such that the rotary drum 36 is formed such as to have a frame-type structure, with a net material attached to this drum 36, or a cloth material which is provided with a multiplicity of small bores is stretched over the drum 36. It is, as a matter of course, possible to attach such a net or cloth material to a certain portion, such as the inner or outer periphery, of the rotary drum 36 arranged in accordance with the above embodiment.

In addition, the recess 50 which is provided in the duct body 44 in the above embodiment is only required to have a curved surface, and it is not necessary for the recess 50 to have a smooth circular cross-section such as that described above. For example, the recess 50 may have a polygonal cross-section, and even in such a case, the photographic paper 14 does not contact the recess 50 and is able to travel without any hindrance.

Also, the return duct 55 is provided in the embodiment shown in FIG. 1 but it may be provided in this invention at need. In case that the return duct 55 is not provided, the casing 12 serves as the return duct substantially.

Figure 10:
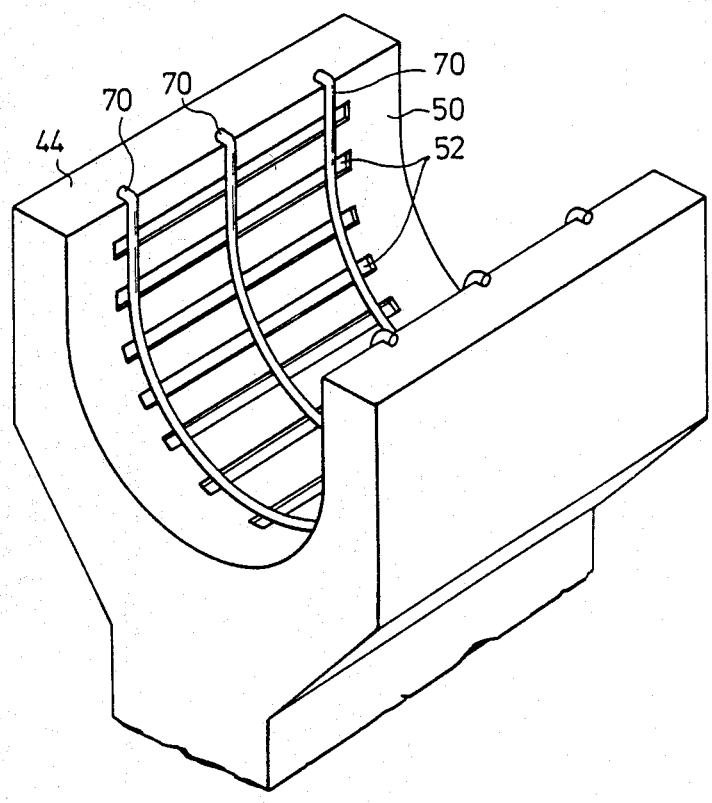
FIG. 10 is a perspective view of another embodiment in which guide rods are provided on recess.
Figure 11:
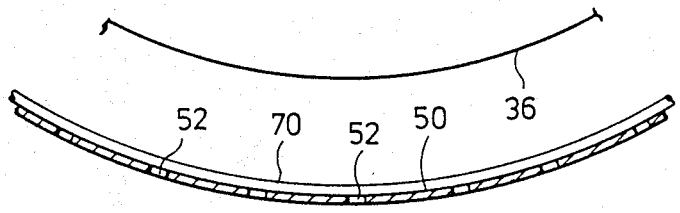
FIG. 11 is a vertical sectional view of FIG. 10.

FIGS. 10 and 11 show the construction that a plurality of guide rods 70 are disposed on the recess across the slits 52. These guide rods 70 are provided along the curve of the recess 50, and they are arranged such that the leading end of the photographic paper 14 supplied is moved smoothy along the guide rods 70.

Accordingly, the leading end of the photographic paper 14 does not adhere to the recess 50, and even though the width of the photographic paper 14 is smaller than the length of the slit 52 the leading end of the photographic paper 14 can be transferred smoothly.

What is claimed is:

1. A drying apparatus for drying photographic paper having an emulsion layer side and a reverse side in a photographic processing, said apparatus comprising:

(a) a rotary drum, the peripheral surface thereof facing the reverse side of the photographic paper opposite to the emulsion layer side thereof;

(b) a duct facing the peripheral surface of said rotary drum so as to define a photographic paper passing area therebetween, said duct being provided with an air outlet bore for blowing drying air onto the emulsion layer side of the photographic paper; and (c) air blowing means for blowing the drying air out of the air outlet bore of said duct on the photographic paper, whereby the photographic paper is transported in such a manner that the reverse side thereof is in contact with the outer periphery of said rotary drum, while the emulsion layer side thereof is kept away from said duct, and the photographic paper is dried from the reverse side thereof by means of said rotary drum, and wherein said rotary drum is rotated at a higher peripheral speed than the speed of travel of the photographic paper, thereby preventing formation of dents in the photographic paper.

2. A drying apparatus according to claim 1, wherein said rotary drum is formed on its peripheral surface with a plurality of bores, whereby the drying air which has been blown onto the photographic paper is discharged through the bores to preheat the rotary drum.

3. A drying apparatus according to claim 2, wherein said bores are provided in the peripheral surface of said rotary drum over a width greater than that of the photographic paper.

4. A drying apparatus according to claim 3, wherein the air outlet bore of said duct is constituted by a slit the longitudinal axis of which extends substantially orthogonally with respect to the direction in which the photographic paper is transported.

5. A drying apparatus according to claim 4, wherein the longitudinal length of said slit is set such as to be smaller than the width of the photographic paper, whereby the leading end of the photographic paper is prevented from being caught by said slit even when the paper curls.

6. A drying apparatus according to claim 5, wherein said slit is provided through formation of a flap by cutting and raising a portion of said duct.

7. A drying apparatus according to claim 4, wherein the longitudinal length of said slit is set such as to be larger than the width of the photographic paper and a guide rod is disposed on the duct along the surface line of the duct across the slit, whereby the leading end of the photographic paper is prevented from being caught by said slit even when the paper curls.

8. A drying apparatus for drying photographic paper having an emulsion layer side and a reverse side in a photographic processing, said apparatus comprising:

(a) a rotary drum disposed such that the reverse side of the photographic paper, opposite to the emulsion layer side thereof, faces the outer periphery of said rotary drum when the paper is transported, said rotary drum having a multiplicity of suction bores provided on the outer periphery thereof;

(b) a duct facing the peripheral surface of said rotary drum so as to define a photographic paper passing area therebetween, said duct being provided with an air outlet bore for blowing warm air to the emulsion layer side of the photographic paper;

(c) air blowing means for the warm air out of the air outlet bore on the photographic paper;

(d) suction means for sucking in the warm air within the photographic paper passing are through said suction bores, whereby said rotary drum is heated and the reverse side of the photographic paper is dried uniformly by said rotary drum; and wherein said rotary drum is rotated at a higher peripheral speed than the travel of the photographic paper, thereby preventing formation of dents in the photographic paper.

9. A drying apparatus according to claim 8, wherein said suction means is constituted by a blower which constitutes said air blowing means.

10. A drying apparatus according to claim 9, wherein said rotary drum, said duct, said blower are housing in a casing, whereby the warm air is circulated through said blower, said duct and said rotary drum.

11. A drying apparatus according to claim 9, wherein said suction means includes a return duct leading the warm air sucked in the suction bores to an air inlet of said blower.

* * * * *